US006305557B1

(12) United States Patent
Brooks

(10) Patent No.: US 6,305,557 B1
(45) Date of Patent: Oct. 23, 2001

(54) FUNNEL SYSTEM FOR HOLDING IMPLEMENTS

(75) Inventor: Jeffrey S. Brooks, St. Louis, MO (US)

(73) Assignee: Jeffrey S. Brooks, Inc., Creve Coeur, MO (US)

( * ) Notice: Subject to any disclaimer, the term of this patent is extended or adjusted under 35 U.S.C. 154(b) by 0 days.

(21) Appl. No.: 09/294,676

(22) Filed: Apr. 19, 1999

(51) Int. Cl.[7] ..... A47F 7/00
(52) U.S. Cl. ..... 211/70.6; 211/94.01
(58) Field of Search ..... 211/70.6, 65, 66, 211/94.01, 175

(56) References Cited

U.S. PATENT DOCUMENTS

| | | | | |
|---|---|---|---|---|
| D. 250,076 | * | 10/1978 | Aust | D6/90 |
| 3,178,141 | * | 4/1965 | Bloom | 211/66 X |
| 3,179,255 | | 4/1965 | De'Caccia . | |
| 3,592,384 | * | 7/1971 | Tomaro | 238/10 E |
| 4,155,460 | | 5/1979 | Ratti | 211/60 |
| 4,161,279 | * | 7/1979 | Halford | 238/10 F |
| 4,179,066 | * | 12/1979 | Teter | 238/10 E |
| 4,341,312 | | 7/1982 | Scholer | 211/60 |
| 4,467,925 | * | 8/1984 | Ratzloff et al. | 211/70.6 |
| 4,852,747 | | 8/1989 | Breveglieri | 211/70.6 |
| 4,871,074 | | 10/1989 | Bryson et al. | 211/13 |
| 5,447,243 | | 9/1995 | Graber | 211/69.5 |
| 5,586,687 | * | 12/1996 | Spamer et al. | 211/74 X |
| 5,641,091 | * | 6/1997 | Daneshvar | 221/3 |
| 5,687,856 | * | 11/1997 | Kendrena | 211/70.6 |
| 5,743,927 | * | 4/1998 | Yemini | 211/70.6 |
| 5,779,145 | * | 7/1998 | Zelle et al. | 238/10 E |

* cited by examiner

*Primary Examiner*—Jerry Redman
*Assistant Examiner*—Erica B. Harris
(74) *Attorney, Agent, or Firm*—Senniger, Powers, Leavitt & Roedel

(57) ABSTRACT

A funnel-shaped holder for holding an implement and it's method of use. The holder includes a funnel structure having an upper end that flares open upwardly and is relatively wide for receiving an implement, a lower end that opens downwardly and is relatively narrow, and a rear wall with a substantially flat vertical inside surface. Opposite converging side walls define, in conjunction with the rear wall, a funnel-shaped recess. A front wall prevents the implement from falling forward out of the recess, and an opening in the front wall allows the implement to be inserted into the funnel-shaped recess and removably held captive in a stored position. A wall-mounted system for holding implements includes a plurality of funnel-shaped holders mountable on a panel support and at least one horizontal track on the panel support to permit the funnel structure to be slidably moved along the track to a selected horizontal position relative to the panel support.

27 Claims, 10 Drawing Sheets

FUNNEL SYSTEM FOR HOLDING IMPLEMENTS

BACKGROUND OF THE INVENTION

This invention relates generally to devices for holding tools, utensils and other implements, and more particularly to a wall-mounted system for holding such items, and to a funnel holder which can be used as part of the system or independent of the system.

Tools and assorted yard and garden implements are often stored against a wall of a garage or work area where they may be conveniently kept and readily picked up. Unfortunately, the area near such a wall can become cluttered. It is desirable to have a system for holding an assortment of items having a variety of shapes and sizes in a compact side-by-side arrangement along a wall where the items may be supported and easily removed.

Numerous systems have been developed for holding and organizing utensils, tools, instruments, etc. to reduce clutter and save space. These systems include pegboards, holders and organizers of the type shown in the following patents:

| Patentee | U.S. Pat. No. |
|---|---|
| De'Caccia | 3,179,255 |
| Ratti | 4,155,460 |
| Scholer | 4,341,312 |
| Breveglieri | 4,852,747 |
| Bryson et al. | 4,871,074 |
| Graber | 5,447,243 |

While these devices are useful to varying degrees, there is still a need for an inexpensive system which is easy to use, easy to mount and which is designed so that it holds a variety of differently sized items at adjustable positions in a sturdy fashion.

SUMMARY OF THE INVENTION

Among the several objects of this invention may be noted the provision of an improved holder and holder system which are inexpensive to make, affordable for the consumer, pleasing to the eye, easy to use and which can readily be mounted on any wall; the provision of such a holder and holder system which can be used to hold items of a variety of shapes and sizes in a stable position; the provision of such a system wherein the items are held in a convenient side-by-side arrangement and are easily removed; the provision of such a system wherein the position of the holder(s) can be adjusted according to the size of the item being held and the desire of the person using the system; the provision of such a holder and system which are designed to prevent the items being held from falling out with a lock in and lock out method of application; the provision of such a system which has an improved configuration for mounting the system on wall studs; and the provision of such a holder and system which are durable and sturdy.

In general, a funnel-shaped holder of this invention is designed for holding an implement having a relatively larger-diameter part and a relatively smaller-diameter part. The holder comprises a funnel structure having an upper end that flares open upwardly and is relatively wide for receiving an implement, a lower end that opens downwardly and is relatively narrow, and a rear wall with a substantially flat vertical inside surface. Opposite converging side walls define, in conjunction with the rear wall, a funnel-shaped recess extending from the upper end of the structure to its lower end. A front wall spaced forward of the rear wall prevents the implement from falling forward out of the recess, and an opening in the front wall allows the smaller-diameter part of the implement to be inserted through the opening into the funnel-shaped recess. The implement is then moved down so that the larger-diameter part is received in the upper end of the funnel structure in a position in which it bears on the converging side walls and is held captive between the front and rear walls of the funnel structure, thereby securely and removably holding the implement in a stored position.

In another aspect, a wall-mounted system for holding implements comprises a panel support adapted to be mounted on a vertical wall, at least one horizontal track on the panel support, and a plurality of holders mountable on the panel support for holding a plurality of implements. Each holder comprises a funnel structure having a relatively wide open upper end and a narrower open lower end whereby an implement can be placed in the funnel structure in a stored position. The implement is engageable with the funnel structure adjacent its upper end and is suspended in a position in which the implements hang down through the lower end of the funnel structure. At least one track-engaging element on the funnel structure slidably engages with the track on the panel support to permit the funnel structure to be slidably moved along the track to a selected horizontal position relative to the panel support.

Other objects and features will be in part apparent and in part pointed out hereinafter.

BRIEF DESCRIPTION OF THE DRAWINGS

Corresponding parts are designated by corresponding reference numbers in the drawings.

DETAILED DESCRIPTION OF THE PREFERRED EMBODIMENT

Figure 1:
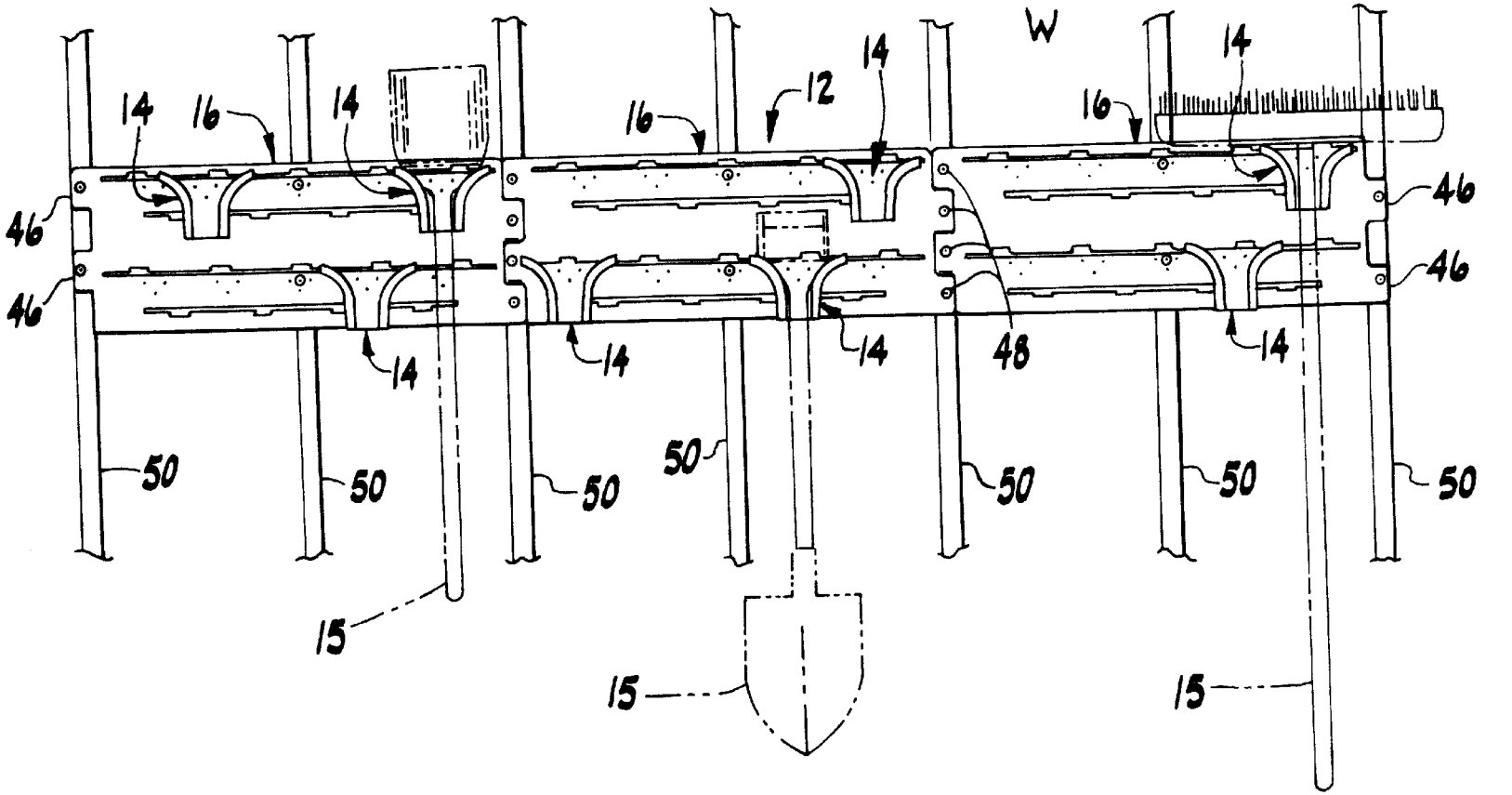
FIG. 1 is an elevational view of a funnel system for holding implements according to the present invention mounted on vertical wall studs.

Referring now to the drawings, and first to FIG. 1, a system of the present invention for holding implements such as kitchen utensils, tools, instruments of various sorts, and other items, is indicated in its entirety by the reference numeral 10. The system comprises a panel support, generally designated 12, adapted to be mounted on a vertical wall W, and a plurality of funnel-shaped holders, each generally indicated at 14, which are mountable on the panel support in selected positions depending on the size of implements 15, the personal preference of the user, and other factors. The panel support 12 comprises a plurality of separate sections 16 that are substantially identical, although it will be understood that the support could be formed of sections that are substantially different or of a single section.

Figure 2:
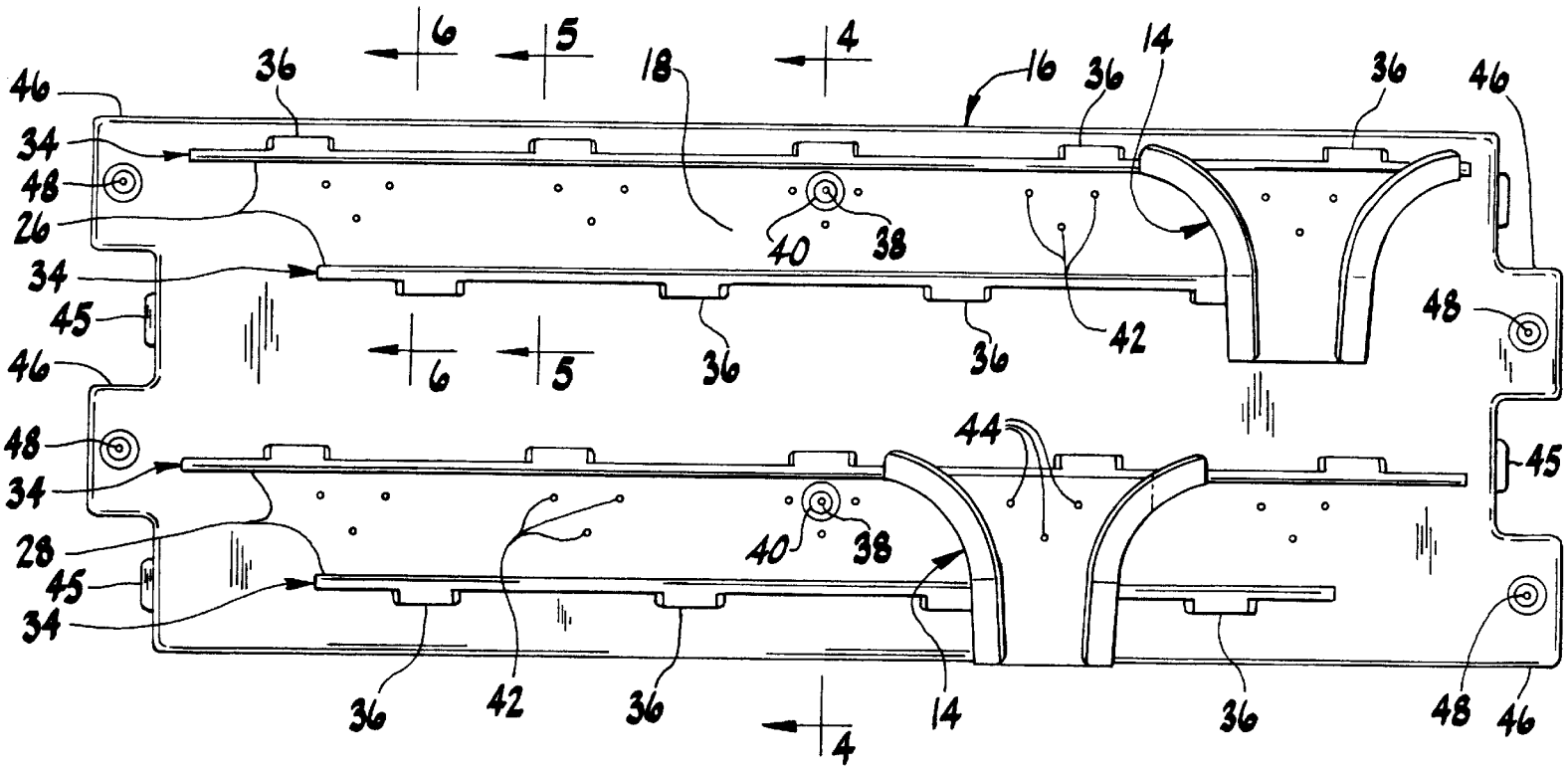
FIG. 2 is an elevational view of a front face of a section of the panel support.
Figure 3:
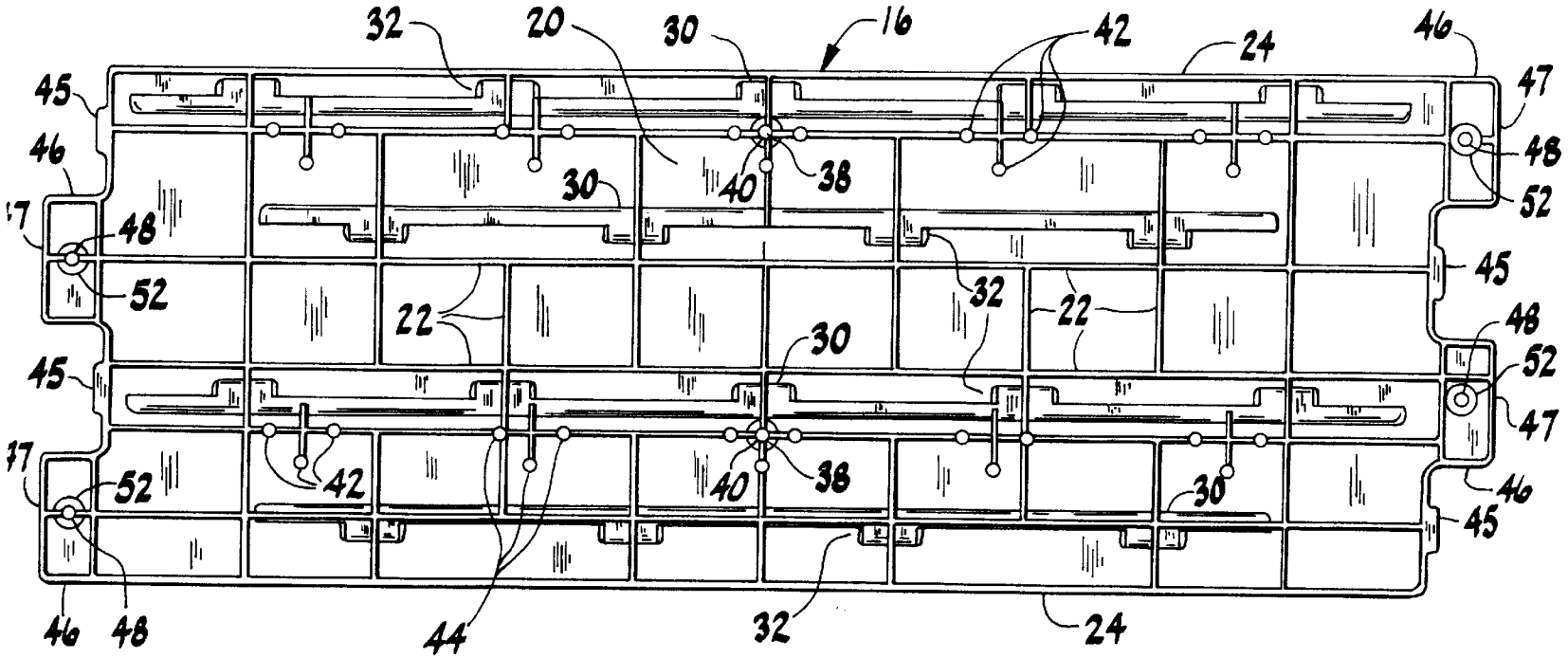
FIG. 3 is an elevational view of a back face of the section.
Figure 4:
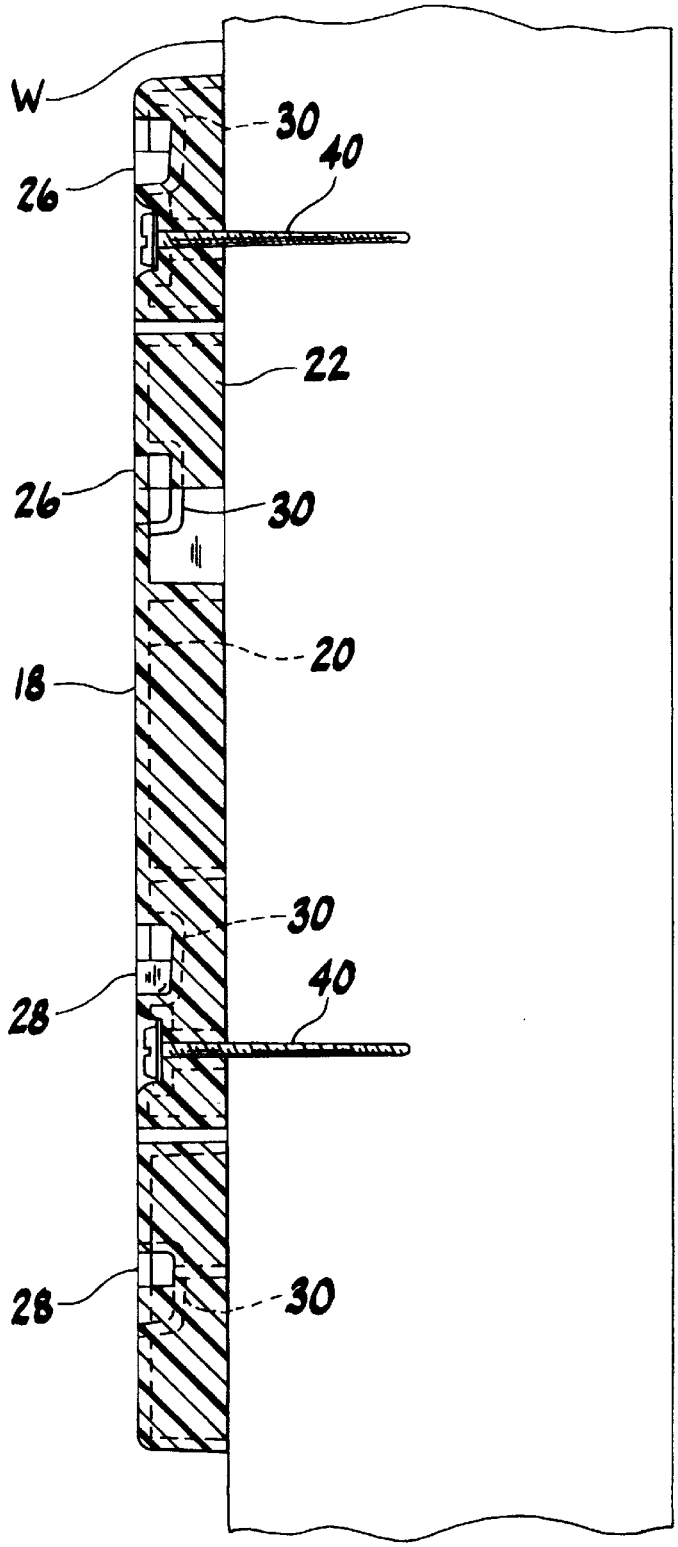
FIG. 4 is a sectional view taken on line 4—4 of FIG. 2.

Each section 16 of the panel support 12 is preferably a one piece injection molded part formed from a suitable plastic such as polyethylene, polypropylene, polyurethane, or polystyrene. As seen in FIGS. 2 and 3, each section 16 comprises a flat (generally planar) sheet having a relatively smooth front face 18, a back face 20 formed with a grid of rearwardly projecting reinforcing ribs 22, and a rearwardly projecting rim 24 around the periphery of the section. The section 16 has an upper pair of generally parallel horizontal slots 26 extending substantially the full length of the section, and a lower pair of similar slots 28.

Slideway members 30 project rearwardly from the back face 20 of the panel section 16 and define horizontal slideways immediately behind the slots 26, 28. As shown best in FIGS. 5 and 6, the slideway members 30 are generally C-Shaped in vertical transverse section. Portions of the slideway members 30 may be removed, as indicated at 32 in FIG. 3, to reduce the weight of the panel section 16. As will be described hereinafter, the slots 26, 28 and slideway members 30 form horizontal tracks 34 for the funnel-shaped holders 14. Alternatively, the tracks 34 may be formed by slots 26, 28 only without the slideway members 30.

The panel support 12 has a series of notches 36 therein extending vertically from each slot 26, 28 at intervals along the slot, the notches extending in an upward direction from the upper slot of each pair of slots and in a downward direction from the lower slot of each pair of slots. These notches 36 allow the holders 14 to be installed in the slideways at multiple locations along the slots 26, 28. The panel support 12 has fastener openings 38 therein for receiving fasteners 40 which are used to secure the section 16 to wall W. The openings 38 preferably extend through ribs 22 on the back face 20 of the section 16 to provide sufficient reinforcement. Additionally, the panel support 12 has a plurality of sets of fastener openings 42 therein for receiving fasteners 44 which are used to secure funnel-shaped holders 14 to the panel support.

The sections 16 of the panel support 12 are formed to fit together end to end, as best illustrated in FIG. 1. Each section 16 has a pair of longitudinal extensions 46 projecting from each end of the section. The extensions 46 each have about the same length and are located so that one panel section 16 may be aligned and fitted with another panel section. An extension 46 of a first section overlaps an extension of a second section in such a way that the tracks 34 (slots 26, 28 and slideway members 30) on the first section are horizontally aligned with the tracks on the second section. (It will be understood that the design could be modified so that the tracks 34 are not aligned.) Each section 16 has a pair of tabs 45 extending from each end of the section. As seen in the back face 20 of the section 16 of FIG. 3, notches 47 for receiving tabs 45 from another, adjacent panel section are formed in the rim 24 and the grid 22. The tabs 45 and notches 47 help align adjacent sections 16. In the preferred embodiment as shown in FIG. 2, the tracks 34 on each section 16 of the panel support 12 are limited in extent and contained within one section. However, the aligned tracks 34 of the first and second sections could extend to the ends of the respective extensions 46 so that the tracks are substantially contiguous, allowing the holders 14 to be slidably moved in the tracks from one section 16 to the other section.

A fastener opening 48 is located about midway along the length of each extension 46. The fastener openings 48 in the extensions and the fastener openings 38 in the panel support both receive fasteners 40 for securing the section 16 to the wall W, although fastener openings in either one location are envisioned as being adequate for securement. The openings 48 are preferably spaced apart a distance corresponding to the standard spacing between vertical wall studs 50 (e.g., 16 inches). As seen in FIG. 1, when the extension 46 of a section 16 is interfitted with an extension of an adjacent section, the fastener openings 48 are vertically aligned so that the sections can more readily be mounted on the relatively narrow available fastening space on a vertical wall stud 50. Cylindric bosses 52 are provided on the back face 20 of the section 16 at the fastener openings 48 on the extensions 46 for receiving fasteners and providing support therefor.

Figure 10:
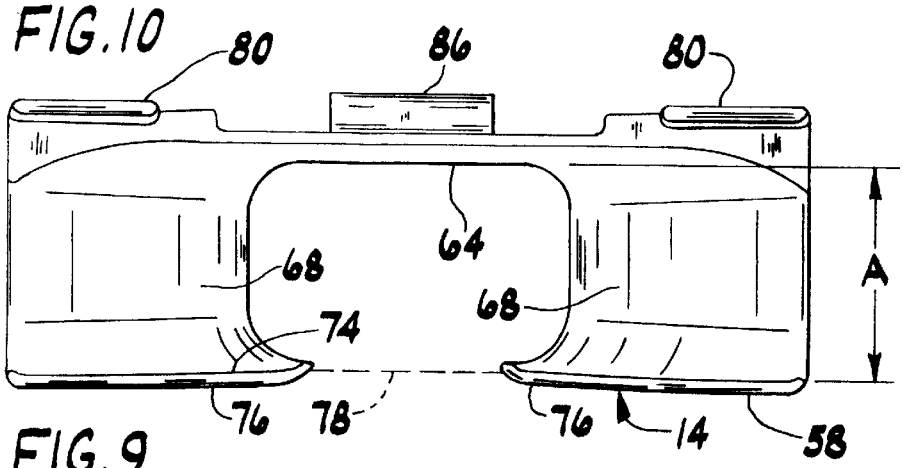
FIG. 10 is a top plan view of the funnel holder structure of FIG. 9.
Figure 9:
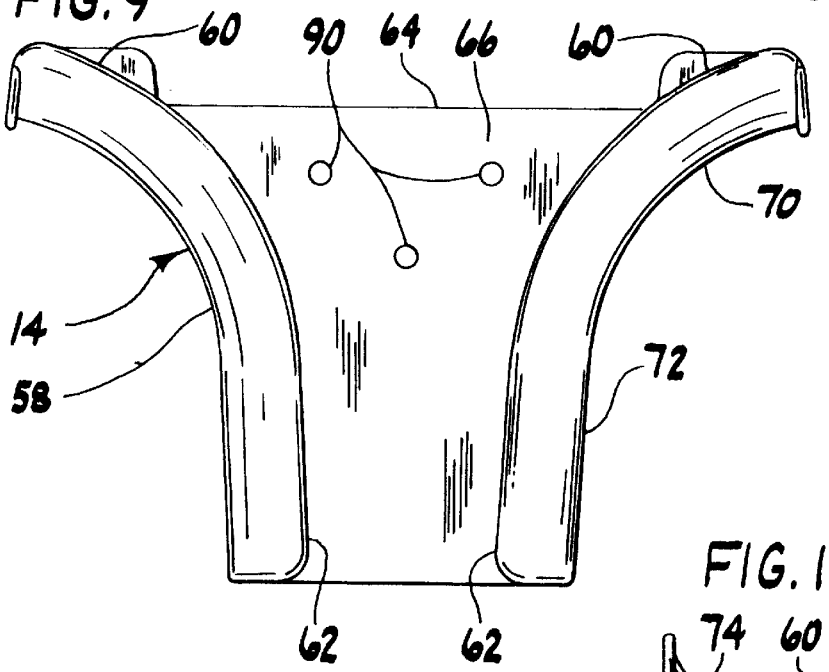
FIG. 9 is a front elevational view of the funnel holder structure.
Figure 11:
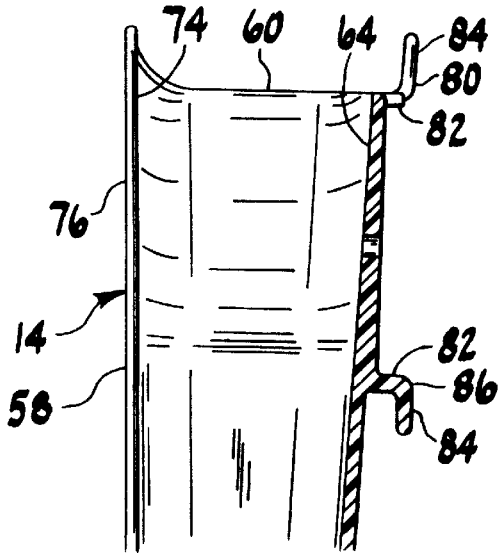
FIG. 11 is a side elevational view of the funnel holder structure of FIG. 9.

As illustrated in FIGS. 9, 10, and 11, each holder 14 comprises a funnel structure 58 having a flaring relatively wide upwardly opening upper end or mouth 60 for receiving an implement, and a narrower downwardly opening lower end 62. The structure 58 further has a rear wall 64 with a substantially flat vertical inside surface 66 and a pair of opposite converging side walls 68 which, in conjunction with the rear wall, define a funnel-shaped recess extending from the upper end 60 of the structure to its lower end 62. Each side wall 68 has an upper curved portion 70 which lies on about a ninety degree arc, and a substantially straight vertical lower portion 72. (The specific configuration of the funnel may vary.)

A front wall 74, comprising a pair of lips 76 at the front of the side walls 68, is spaced forward of the rear wall 64 for preventing an implement in the holder 14 from falling forward out of the recess. The two lips 76 define a vertical opening or slot 78 in the front wall through which a smaller-diameter part of the implement 15, such as a shaft of a handle, can be inserted into the funnel-shaped recess. The implement 15 can then be moved down (lowered or dropped) so that a larger-diameter part of the implement, such as a head or body, is received in the upper end 60 of the funnel structure 58 in a position in which it bears on the converging side walls 68 and is held captive between the front wall 74 and rear wall 64 of the funnel structure. The implement 15 is effectively locked in place, securely and removably held in a stored position. To unlock and remove the implement 15 from the funnel holder 14, these steps are reversed. The implement 15 is moved up and the smaller diameter part can be removed through the opening 78.

The slot 78 defined by the lips 76 preferably has a width in the range of about 1 to 2 in., more preferably in the range of about 1¼ to 1¾ in., and most preferably about 1½ in. which is sufficient to accommodate most implements, but this width may vary. As shown best in FIG. 10, the upper end of the funnel structure 58 has a depth A which is sized to hold the large-diameter part of certain implements 15. While this dimension A will vary depending on the intended use of the present invention, a depth of about 1½ to 2 in. has been found to be suitable for many consumer applications.

Implements 15 that are very large and unable to fit within a funnel holder 14 may be mounted on the panel support 12 by supporting the implement on two adjacent holders. These large implements 15 can be bridged across two adjacent holders 14, with the implement either resting on top of the holders or fitting in the upper ends 60 of the funnel structures.

The holder 14 illustrated in FIGS. 9, 10, and 11 is provided with means for mounting the funnel structure 58 on the panel support 12. In the preferred embodiment, this mounting means comprises one or more track-engaging elements, preferably a pair of upper L-shaped mounting tabs 80, or brackets, each having a horizontal leg 82 extending back from an upper portion of the rear wall 64 of the funnel structure 58 and a vertical leg 84 extending up from the horizontal leg, and a single lower L-shaped mounting tab 86, or bracket, having a horizontal leg 82 extending back from a bottom portion of the rear wall and a vertical leg 84 extending down from the horizontal leg.

Figure 6:
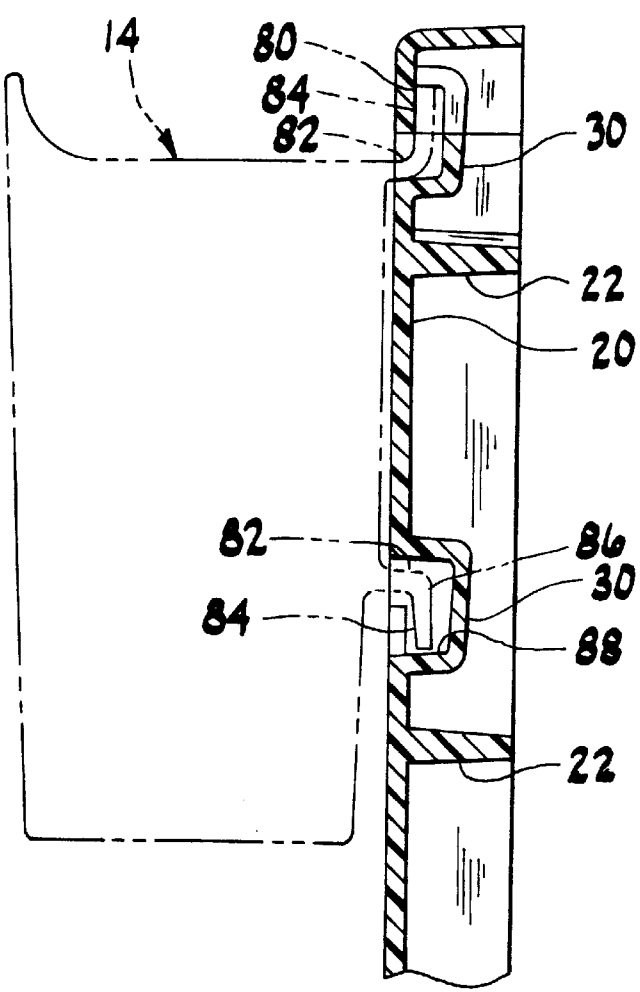
FIG. 6 is a sectional view taken on line 6—6 of FIG. 2.
Figure 5:
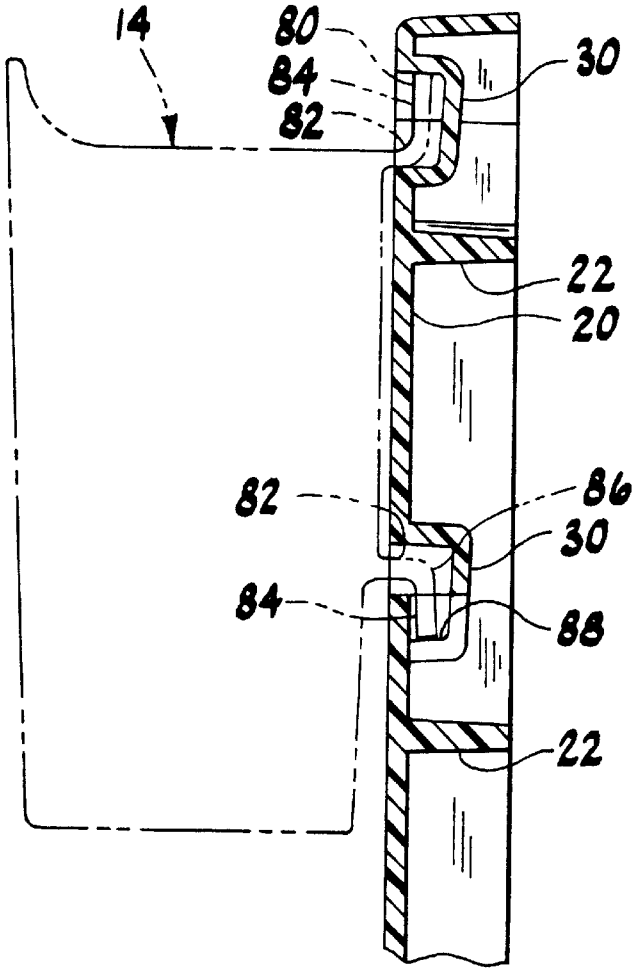
FIG. 5 is a sectional view taken on line 5—5 of FIG. 2.
Figure 7:
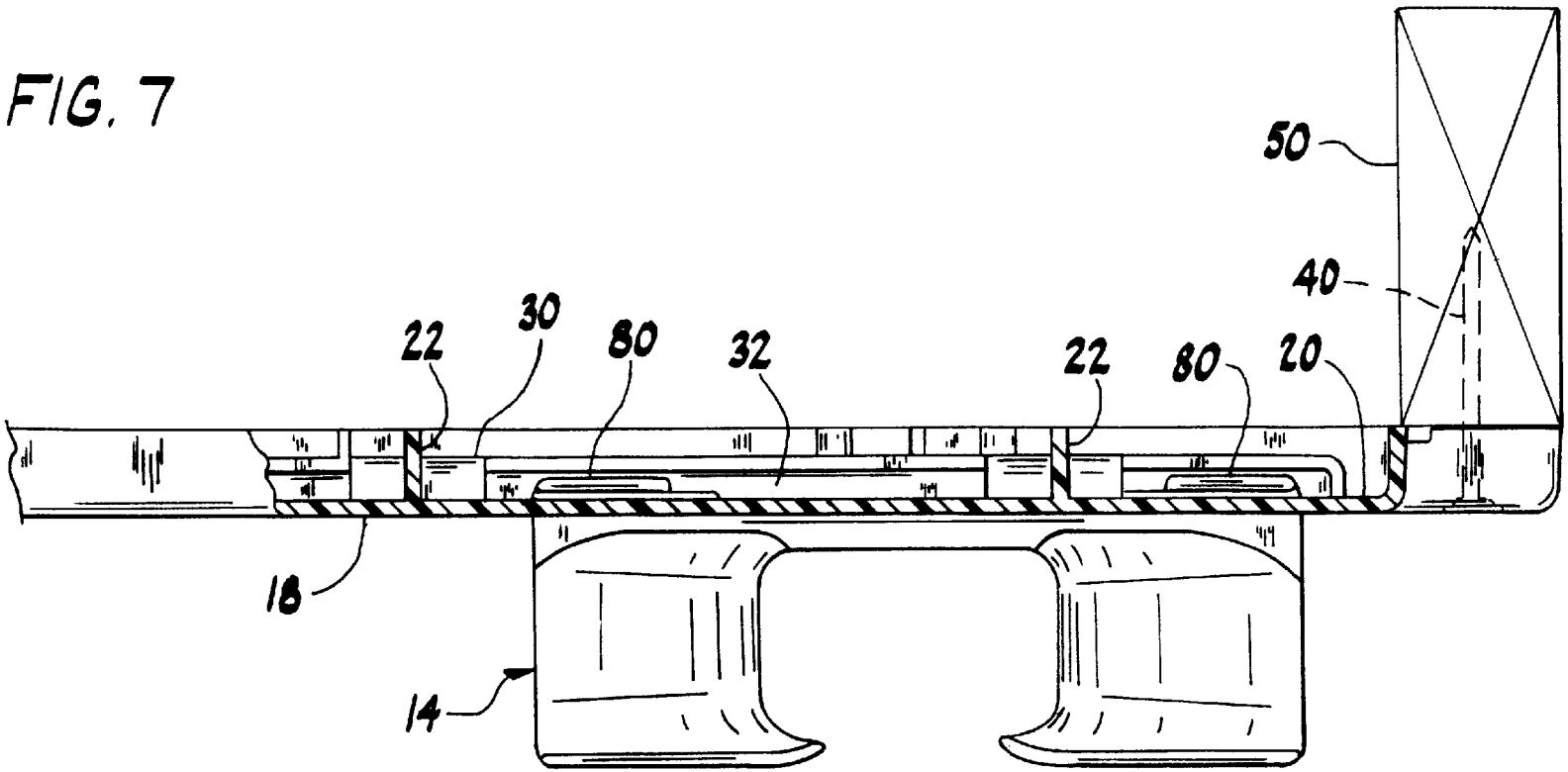
FIG. 7 is a top plan view partially in section of a funnel holder mounted on the panel support.

The upper and lower mounting tabs 80, 86 are engageable with respective horizontal tracks 34 on the panel support 12. In particular, the mounting tabs 80, 86 are insertable into and through respective upper and lower notches 36 and slots 26, 28 formed in the panel support 12 to positions in which the tabs are received in respective slideway members 30. As shown in FIGS. 5 and 6, the horizontal legs 82 of the upper tabs 80 bear on bottoms of the slideway members 30, and the vertical legs 84 of the upper tabs engage the back face 20 of the panel. In the preferred design, the horizontal leg 82 of the single lower tab 86 is spaced slightly above and out of contact with a bottom edge 88 of the lower slot of the respective pair of slots 26, 28 and the vertical leg 84 is spaced slightly above and out of contact with a bottom of the respective slideway member 30. The vertical leg 84 of the lower tab 86 is positioned closely adjacent the back face 20 of the panel support 12 to maintain the funnel holder 14 in proper vertical position relative to the panel support.

Each holder 14, including the funnel structure 58 and mounting means, is preferably a one-piece injection molded part formed from a suitable plastic such as polyethylene, polypropylene, polyurethane, or polystyrene. Several holders 14 can be nested together in a compact stack arrangement for packaging or transport, with the lower end 62 of each holder fitting into the upper end 60 of an adjacent holder.

Figure 8:
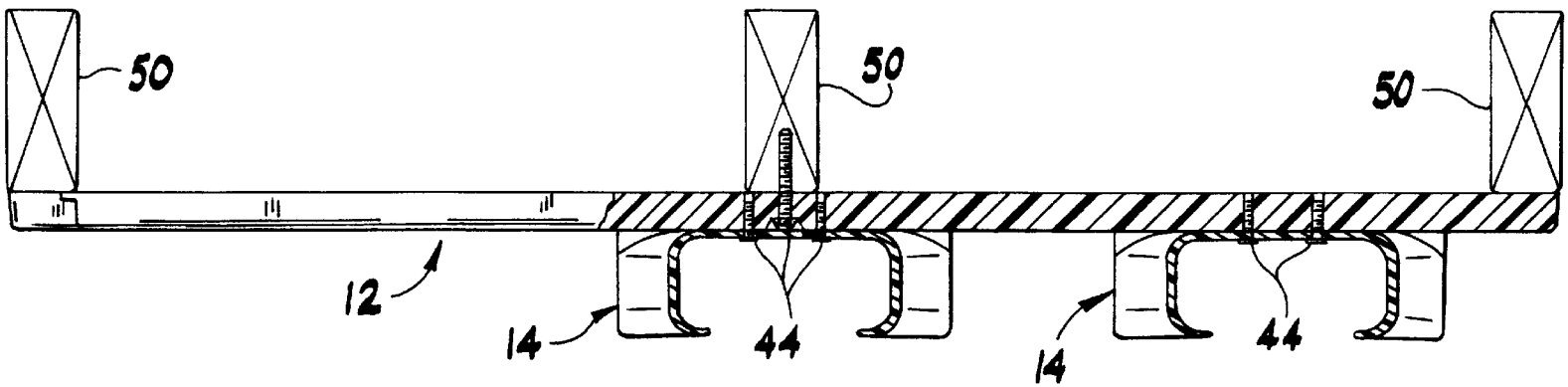
FIG. 8 is a bottom view partially in section of two funnel holders mounted on the panel support.

The holder 14 can be slidably moved to a position in which one or more fastener openings 90 in the rear wall 64 of the holder are aligned with a selected set of preformed corresponding fastener openings 42 in the panel support 12. One or more fasteners 44 (e.g., screws) can be inserted through the openings 90 to secure the holder 14 in fixed position on the panel support 12. As shown in FIG. 8, the fasteners 44 may extend into a vertical wall stud 50, as when the funnel holder 14 is positioned in front of the stud, or the fasteners may extend only into the panel support 12. Other means of securement may also be suitable. Alternatively, the holder 14 may not be secured in fixed position, but rather simply moved as by lateral sliding relative to the slideway members 30 to a desired position where it will remain until moved again.

It will be understood that other types of means can be used to mount the holders 14 on the panel support 12 without departing from the scope of this invention, so long as the holders are capable of being securely mounted on the panel support. Further, the panel support 12 and sections 16 thereof may have a variety of shapes and may have no longitudinal extensions 46. It is also contemplated that one or three (instead of two) horizontal tracks 34 may be used for each holder 14. Further, the tracks 34 can be eliminated entirely and the holders 14 simply secured in fixed position to the panel support 12 by fasteners or the like.

The shape of the funnel structure 58 may vary without departing from the scope of this invention, bearing in mind that the inside surface of the rear wall 64 should be substantially flat for stable flatwise engagement by the implement 15. Also, the upper extremities of the upper portion 70 of the side walls 68 preferably form a generally horizontal shelf for stably supporting the implement 15 in a manner in which the weight of the implement is spread over a substantial load bearing area.

Figure 12:
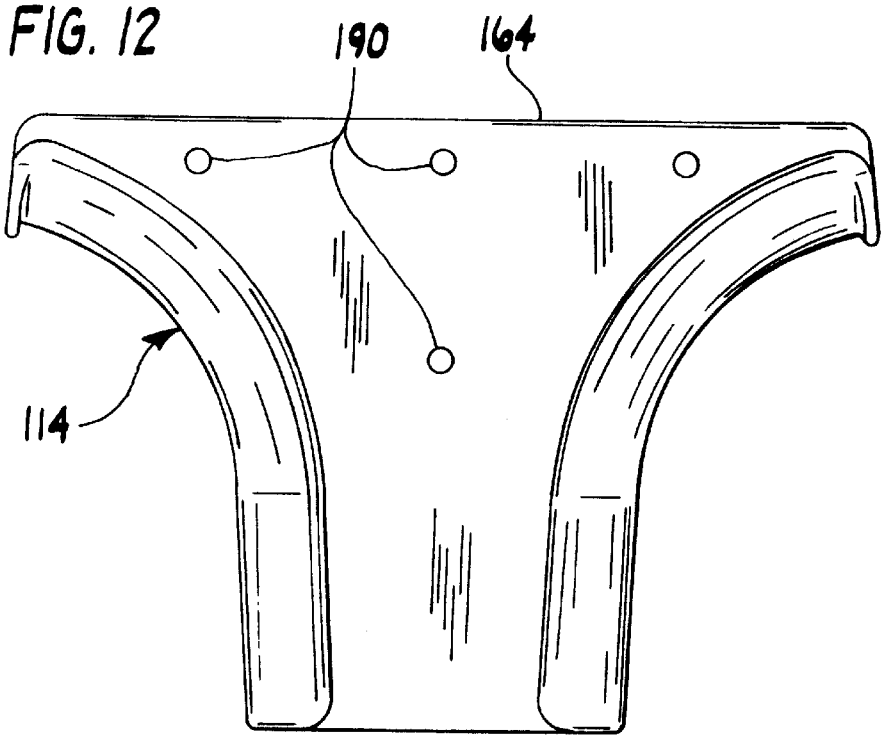
FIG. 12 is a front elevational view of a funnel holder of a second embodiment which can be used independently of the panel support.
Figure 13:
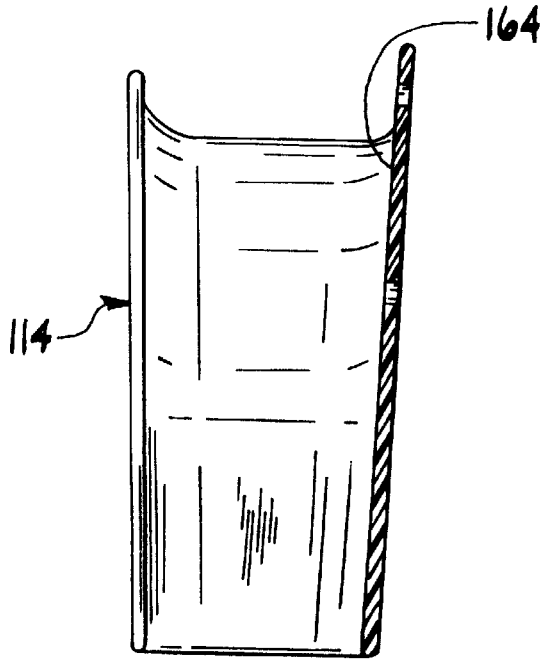
FIG. 13 is a side elevational view of the funnel holder of FIG. 12.

FIGS. 12 and 13 illustrate a holder of a second embodiment which can be used independently of the panel support. Corresponding parts of the funnel holder of the second embodiment are generally designated by the same reference numbers as the funnel holder 14 of the first embodiment with the addition of the prefix "1." The holder, generally designated by the reference numeral 114, is identical to the holder 14 of the first embodiment, except that it does not include mounting tabs. The holder 114 has suitable means, such as one or more fastener openings 190, in its rear wall 164, for fastening the holder to a wall or other surface. Other means, such as adhesive, hook and loop fasteners (VELCRO), or the like can also be used for permanently or temporarily mounting the holder 114.

Figure 14:
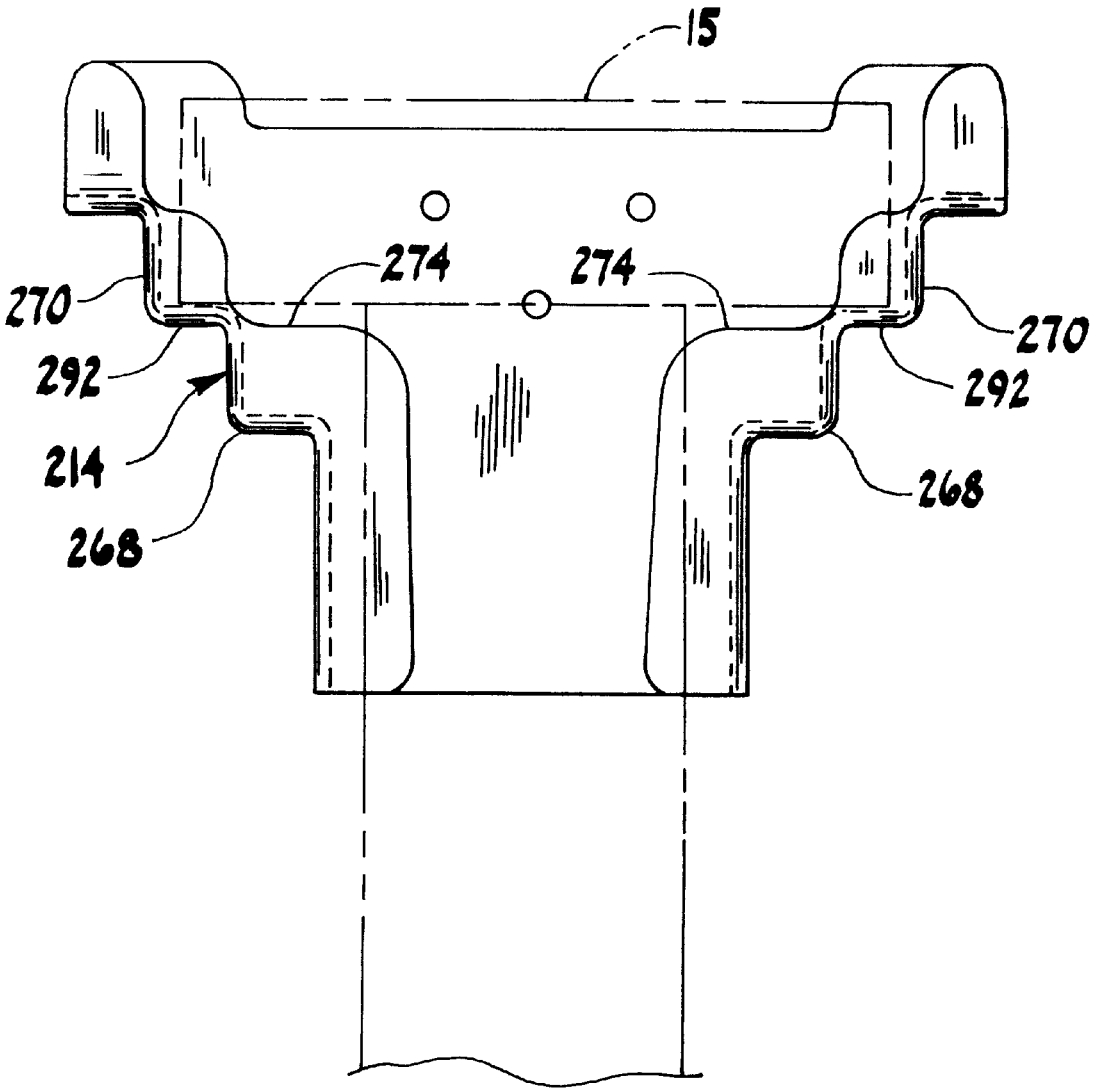
FIG. 14 is a front elevational view of a funnel holder of a third embodiment which has stepped side walls.

A third embodiment 214 of the funnel holder is shown in FIG. 14. Corresponding parts of the funnel holder of the third embodiment are generally designated by the same reference numbers as the funnel holder 14 of the first embodiment with the addition of the prefix "2." The funnel holder 214 has side walls 268 with upper portions 270 that have a stair-like stepped configuration. In this embodiment, the implement 15 is lowered until the larger-diameter part bears on a pair of steps 292 having a spacing that approximately matches the width of the part. A front wall 274 defining a vertical opening in the front wall may be contoured as shown in FIG. 14, although it is understood that the specific configuration of the front wall may vary.

Thus the holder system can stably hold items of a variety of shapes and sizes in a side-by-side arrangement where they are easily removed. The position of the holder(s) can be readily adjusted. The system is easily mounted on wall studs.

In view of the above, it will be seen that the several objects of the invention are achieved and other advantageous results obtained.

As various changes could be made in the above without departing from the scope of the invention, it is intended that all matter contained in the above description and shown in the accompanying drawings shall be interpreted as illustrative and not in a limiting sense.

What is claimed is:

1. A funnel-shaped holder for holding an implement having a relatively larger-diameter part and a relatively smaller-diameter part, said holder comprising a funnel structure having an upper end that flares open upwardly and is relatively wide for receiving an implement, a lower end that opens downwardly and is relatively narrow, a rear wall with a substantially flat vertical inside surface, opposite converging side walls configured for direct engagement by said larger-diameter part of the implement, each side wall extending non-linearly from the upper end of the holder to the lower end of the holder, the side walls defining, in conjunction with said rear wall, a funnel-shaped recess extending from the upper end of the structure to its lower end, a front wall spaced forward of the rear wall for preventing said implement from falling forward out of the recess, and an opening in the front wall for allowing the smaller-diameter part of the implement to be inserted through the opening into the funnel-shaped recess and the implement then moved down so that the larger-diameter part is received in the upper end of the funnel structure in a position in which it bears in direct engagement on the converging side walls, generally spans the side walls, and is held captive between the front and rear walls of the funnel structure thereby securely and removably holding the implement in a stored position.

2. The funnel-shaped holder as set forth in claim 1 wherein the front wall of said funnel structure is defined by a pair of lips on the side walls of the funnel structure extending generally parallel to the rear wall.

3. The funnel-shaped holder as set forth in claim 1 wherein each side wall has an upper portion that is curved and configured for stably supporting the implement, and each side wall further having a lower portion that is generally straight and vertically oriented.

4. The funnel-shaped holder as set forth in claim 3 wherein said upper portion of each side wall curves on an arc of about ninety degrees.

5. The funnel-shaped holder as set forth in claim 1 further comprising mounting means for mounting said funnel structure on a wall.

6. The funnel-shaped holder as set forth in claim 5 wherein said mounting means comprises one or more fastener holes in the rear wall of the funnel structure.

7. The funnel-shaped holder as set forth in claim 5 wherein said mounting means comprises at least one track-engaging element on the rear wall of the funnel structure slidably engageable with a track on a wall-mounted support.

8. The funnel-shaped holder as set forth in claim 7 wherein said mounting means comprises upper and lower track-engaging elements on the rear wall of the funnel structure slidably engageable with upper and lower tracks on the wall-mounted support.

9. The funnel-shaped holder as set forth in claim 7 wherein said track-engaging element comprises an L-shaped tab.

10. A funnel-shaped holder in combination with a panel support for supporting the holder, said funnel-shaped holder comprising a funnel structure having an upper end that flares open upwardly and is relatively wide for receiving an implement, a lower end that opens downward l and is relatively narrow, a rear wall with a substantially flat vertical inside surface, opposite converging side walls extending non-linearly from the upper end of the holder to the lower end of said holder for direct engagement by said larger-diameter part of the implement, the side walls defining, in conjunction with said rear wall, a funnel-shaped recess extending from the upper end of the structure to its lower end, a front wall spaced forward of the rear wall and projecting above said side walls for preventing said implement from falling forward out of the recess, and an opening in the front wall for allowing the smaller-diameter part of the implement to be inserted through the opening into the funnel-shaped recess and the implement then moved down so that the larger-diameter part is received in the upper end of the funnel structure in a position in which it bears in direct engagement on the converging side walls and is held captive between the front and rear walls of the funnel structure thereby securely and removably holding the implement in a stored position; and said panel support comprising a plurality of separate sections formed to fit together end to end, each section having longitudinal extensions projecting from opposite ends of the section, said extensions having about the same length whereby one section may be aligned and fitted with another section with an extension of one section overlapping an extension of the other section.

11. The combination as set forth in claim 10 wherein the extensions at opposite ends of each section are interdigitated and have fastener openings therein for fastening the support section to a wall, wherein said panel support has a plurality of fastener openings therein spaced at locations along the support, and wherein the rear wall of the holder has at least one fastener opening therein adapted to align with a selected fastener opening in the panel support for receiving a fastener through said aligned openings to secure the holder to the support.

12. A wall-mounted system for holding implements, said system comprising:

a panel support adapted to be mounted on a vertical wall;

at least one horizontal track on said panel support; and a plurality of holders mountable on said panel support for holding said implements, each holder comprising a funnel structure having a relatively wide open upper end, a narrower open lower end, opposite converging side walls defining a funnel-shaped recess, and a front wall projecting above said side walls for preventing an implement from falling forward out of the recess whereby the implement can be inserted in the funnel structure in a stored position in which the implement is directly engageable with the side walls of the funnel structure adjacent its upper end and is suspended in a position in which the implement hangs down through the lower end of the funnel structure, said funnel-shaped recess being unoccupied prior to insertion of the implement whereby after such insertion the implement can be moved downwardly to bring the implement into direct engagement with said converging side walls of the funnel structure, and at least one track-engaging element on the funnel structure slidably engageable with the track on the panel support to permit the funnel structure to be slidably moved along the track to a selected horizontal position relative to the panel support.

13. A system as set forth in claim 12 wherein said track comprises a horizontal slideway on the panel support, said holders being slidably movable to selected positions along the slideway.

14. A system as set forth in claim 13 wherein said panel support has a pair of generally horizontal tracks comprising upper and lower slots in a front face of the support extending along the support generally parallel to one another, and wherein said at least one track engaging element comprises upper and lower tabs on the funnel structure receivable in said upper and lower slots, respectively, for engaging the panel support to retain the holder on the tracks.

15. A system as set forth in claim 13 wherein said slideway comprises a horizontal slot in the support panel and at least one notch in the panel enlarging the slot to permit insertion of said at least one track-engaging element into and through the slot for movement of the holder along the slideway.

16. A system as set forth in claim 15 wherein the support panel has a series of notches therein spaced at intervals along the slot to permit a holder to be inserted through the slot and into said slideway at multiple locations along the slot.

17. A system as set forth in claim 12 wherein said panel support has fastener openings spaced apart a distance corresponding to the spacing between building studs.

18. A system as set forth in claim 12 wherein said panel support comprises a plurality of separate longitudinal sections formed to fit together end to end, each section having a pair of longitudinal extensions projecting from opposite ends of the section, said extensions having about the same length whereby one section may be aligned and fitted with another section so that an extension of one section overlaps an extension of the other section in such a way that the track on said one section is aligned and substantially contiguous with the track on said other section for allowing a holder to be slidably moved in the tracks from one section to the other section.

19. A system as set forth in claim 18 wherein the extensions at opposite ends of each section have fastener openings therein for fastening the panel support section to a wall.

20. A system as set forth in claim 12 wherein said panel support has a plurality of sets of fastener openings therein spaced at intervals along the panel support, each set being adapted for receiving fasteners to secure a holder to the panel support in a selected position on the support.

21. A wall-mounted system for holding implements, said system comprising:

a panel support adapted to be mounted on a vertical wall, said panel support having upper and lower edges;

at least one horizontal track on said panel support, said track comprising an upper horizontal slot in the panel support spaced below the upper edge of the panel support and a lower horizontal slot in the panel support spaced above the lower edge of the panel support;

means for mounting the panel support on the wall; and a plurality of holders mountable on said panel support for holding said implements, each holder comprising a funnel structure having a relatively wide open upper end, a narrower open lower end, and opposite converging side walls defining a funnel-shaped recess whereby the implement can be inserted in the funnel structure in a stored position in which the implement is directly engageable with the side walls of the funnel structure adjacent its upper end and is suspended in a position in which the implement hangs down through the lower end of the funnel structure, said funnel-shaped recess being unoccupied prior to insertion of the implement whereby after such insertion the implement can be moved down into the funnel structure to bring the implement into direct engagement with said converging side walls of the funnel structure, said direct engagement serving to support the implement, and upper and lower slot-engaging elements on the funnel structure slidably engageable with respective upper and lower slots in the panel support to permit the funnel structure to be slidably moved along the track to a selected horizontal position relative to the panel support.

22. A method as set forth in claim 21 wherein the step of inserting said implement further comprises:

holding the implement with said larger-diameter part at an elevation generally above an elevation of said upper end of the funnel-shaped holder and said smaller-diameter part extending downwardly below said larger-diameter part to an elevation generally below an elevation of said lower end of the funnel-shaped holder; and moving the implement in a manner wherein the smaller-diameter part of the implement passes through the opening in the front wall of the funnel-shaped holder.

23. A method as set forth in claim 22 wherein said step of resting said implement in the funnel-shaped holder further comprises moving said implement downwardly to a position where said larger-diameter part of the implement spans the converging side walls of the funnel-shaped holder and is between said rear wall and said front wall.

24. A method as set forth in claim 21 wherein the steps of inserting and resting said implement comprise moving the implement with sequential motions that are generally in a horizontal direction and a vertically downward direction, with no substantial component of motion being in a vertically upward direction.

25. In combination, a funnel-shaped holder and an implement held by the holder, the implement having a relatively larger-diameter part and a relatively smaller-diameter part, the holder comprising a funnel structure having an upper end that flares open upwardly and is relatively wide for receiving said implement, a lower end that opens downwardly and is relatively narrow, a rear wall with a substantially flat vertical inside surface, opposite converging side walls extending non-linearly from the upper end of the holder to the lower end of said holder for direct engagement by said larger-diameter part of the implement, the side walls defining, in conjunction with said rear wall, a funnel-shaped recess extending from the upper end of the structure to its lower end, a front wall spaced forward of the rear wall for preventing said implement from falling forward out of the recess, and an opening in the front wall for allowing said smaller-diameter part of the implement to be inserted through the opening into the funnel-shaped recess and the implement then moved down so that the larger-diameter part is received in the upper end of the funnel structure in a position in which it bears in direct engagement on the converging side walls and is held captive between the front and rear walls of the funnel structure thereby securely and removably holding the implement in a stored position.

26. A wall-mounted system for holding implements, said system comprising:

a panel support adapted to be mounted on a vertical wall, said panel support having upper and lower edges;

at least one horizontal track on said panel support, said track comprising an upper horizontal slot in the panel support spaced below the upper edge of the panel support and a lower horizontal slot in the panel support spaced above the lower edge of the panel support;

means for mounting the panel support on the wall; and a plurality of holders mountable on said panel support for holding said implements, each holder comprising a funnel structure having a relatively wide open upper end, a narrower open lower end, and opposite converging side walls extending non-linearly from the upper end of the holder to the lower end of said holder for direct engagement by one of said implements whereby the implement can be placed in the funnel structure in a stored position in which the implement is directly engageable with the funnel structure adjacent its upper end and is suspended in a position in which the implement hangs down through the lower end of the funnel structure, and upper and lower slot-engaging elements on the funnel structure slidably engageable with respective upper and lower slots in the panel support to permit the funnel structure to be slidably moved along the track to a selected horizontal position relative to the panel support.

27. A wall-mounted system as set forth in claim 26 wherein said panel support has a pair of said horizontal tracks, one track spaced below the other track, for slidably mounting two rows of holders on the panel support.

* * * * *

UNITED STATES PATENT AND TRADEMARK OFFICE

CERTIFICATE OF CORRECTION

PATENT NO. : 6,305,557 B1
DATED : October 23, 2001
INVENTOR(S) : Jeffrey S. Brooks It is certified that error appears in the above-identified patent and that said Letters Patent is hereby corrected as shown below:

Title page,
Item [56], References Cited, patent reference "5,743,927 Yemini" should read -- 5,740,927, Yemini --.

Column 7,
lines 42-65, "said funnel-shaped holder comprising a funnel structure having an upper end that flares open upwardly and is relatively wide for receiving an implement, a lower end that opens downward 1 and is relatively narrow, a rear wall with a substantially flat vertical inside surface, opposite converging side walls extending non-linearly from the upper end of the holder to the lower end of said holder for direct engagement by said larger-diameter part of the implement, the side walls defining, in conjunction with said rear wall, a funnel-shaped recess extending from the upper end of the structure to its lower end, a front wall spaced forward of the rear wall and projecting above said side walls for preventing said implement from falling forward out of the recess, and an opening in the front wall for allowing the smaller-diameter part of the implement to be inserted through the opening into the funnel-shaped recess and the implement then moved down so that the larger-diameter part is received in the upper end of the funnel structure in a position in which it bears in direct engagement on the converging side walls and is held captive between the front and rear walls of the funnel structure thereby securely and removable holding the implement in a stored position; and"

should read:

-- said funnel-shaped holder comprising a funnel structure having an upper end that flares open upwardly and is relatively wide for receiving an implement having a relatively larger-diameter part and a relatively smaller-diameter part, a lower end that opens downwardly and is relatively narrow, a rear wall with a substantially flat vertical inside surface, opposite converging side walls for direct engagement by said larger-diameter part of the implement, the side walls defining, in conjunction with said rear wall, a funnel-shaped recess extending from the upper end of the structure

UNITED STATES PATENT AND TRADEMARK OFFICE

CERTIFICATE OF CORRECTION

PATENT NO. : 6,305,557 B1
DATED : October 23, 2001
INVENTOR(S) : Jeffrey S. Brooks It is certified that error appears in the above-identified patent and that said Letters Patent is hereby corrected as shown below:

Column 7 cont'd,
to its lower end, a front wall spaced forward of the rear wall and projecting above said side walls for preventing said implement from falling forward out of the recess, and an opening in the front wall for allowing the smaller-diameter part of the implement to be inserted through the opening into the funnel-shaped recess, said funnel-shaped recess being unoccupied prior to insertion of the implement into the opening whereby after such insertion the implement can be moved down into the recess to bring the larger-diameter part of the implement into direct engagement with said converging side walls of the funnel structure, said direct engagement serving to support the implement in a position in which the implement is held captive between the front and rear walls of the funnel structure thereby securely and removable holding the implement in a stored position; and --.

Column 9 to Column 10,
Lines 55-67 and Lines 1-33, please delete claims 22 through 25.

Column 10,
Lines 34-61, should be deleted.
Lines 62-65, claim 27 should depend from claim 21 of the printed patent.
After line 65, please insert claim 30 as follows:
-- A funnel-shaped holder for holding an implement having a relatively larger-diameter part and a relatively smaller-diameter part, said holder comprising a funnel structure having an upper end that flares open upwardly and is relatively wide for receiving an implement, a lower end that opens downwardly and is relatively narrow, a rear wall with a subtantially flat vertical inside surface, opposite converging side walls configured for direct engagement by said larger-diameter part of the implement, the side walls

UNITED STATES PATENT AND TRADEMARK OFFICE

CERTIFICATE OF CORRECTION

PATENT NO. : 6,305,557 B1
DATED : October 23, 2001
INVENTOR(S) : Jeffrey S. Brooks It is certified that error appears in the above-identified patent and that said Letters Patent is hereby corrected as shown below:

Column 10 cont'd,
defining, in conjunction with said rear wall, a funnel-shaped recess extending from the upper end of the structure to its lower end, a front wall spaced forward of the rear wall and projecting above said side walls for preventing said implement from falling forward out of the recess, and an opening in the front wall for allowing the smaller-diameter part of the implement to be inserted through the opening into the funnel-shaped recess and the implement then moved down so that the larger-diameter part is received in the upper end of the funnel structure in a position in which it bears in direct engagement on the converging side walls, generally spans the side walls, and is held captive between the front and rear walls of the funnel structure thereby securely and removably holding the implement in a stored position --.

Signed and Sealed this

Eighteenth Day of June, 2002

*Attest:*

*Attesting Officer*

JAMES E. ROGAN
*Director of the United States Patent and Trademark Office*